US011639807B2

(12) United States Patent
Okada et al.

(10) Patent No.: US 11,639,807 B2
(45) Date of Patent: May 2, 2023

(54) AIR CONDITIONING MANAGEMENT SYSTEM

(71) Applicant: DAIKIN INDUSTRIES, LTD., Osaka (JP)

(72) Inventors: Ryohei Okada, Osaka (JP); Takuya Fumimoto, Osaka (JP); Yoshihide Nomura, Osaka (JP)

(73) Assignee: Daikin Industries, Ltd., Osaka (JP)

( * ) Notice: Subject to any disclaimer, the term of this patent is extended or adjusted under 35 U.S.C. 154(b) by 0 days.

(21) Appl. No.: 17/742,072

(22) Filed: May 11, 2022

(65) Prior Publication Data

US 2022/0268474 A1 Aug. 25, 2022

Related U.S. Application Data

(63) Continuation of application No. PCT/JP2020/043899, filed on Nov. 25, 2020.

(30) Foreign Application Priority Data

Nov. 26, 2019 (JP) ..... JP2019-213229

(51) Int. Cl.
*F24F 11/54* (2018.01)
*F24F 11/49* (2018.01)
(Continued)

(52) U.S. Cl.
CPC ..... *F24F 11/54* (2018.01); *F24F 11/49* (2018.01); *F24F 11/58* (2018.01); *F24F 2110/10* (2018.01)

(58) Field of Classification Search
CPC ..... F24F 11/54; F24F 11/49; F24F 11/58
See application file for complete search history.

(56) References Cited

U.S. PATENT DOCUMENTS

2004/0049320 A1 3/2004 Takai et al.
2010/0185758 A1* 7/2010 Hoga ..... H04L 41/0893 700/9
(Continued)

FOREIGN PATENT DOCUMENTS

EP 2 199 698 A1 6/2010
EP 3 521 722 A1 8/2019
(Continued)

OTHER PUBLICATIONS

International Preliminary Report of corresponding PCT Application No. PCT/JP2020/043899 dated Jun. 9, 2022.
(Continued)

*Primary Examiner* — Mohammad Ali
*Assistant Examiner* — Vincent W Chang
(74) *Attorney, Agent, or Firm* — Global IP Counselors, LLP

(57) ABSTRACT

An air conditioning management system is configured to manage a plurality of air conditioners as management targets. The air conditioning management system includes a controller connected to the air conditioners, and a server apparatus connected to the controller. The controller is configured to execute a management program to manage the air conditioners. The server apparatus is configured to provide the controller with an air conditioner data model as a collection of data on the air conditioners to be referred to in the management program. The air conditioner data model is information on the air conditioners to be referred to in the management program. The air conditioner data model is provided for each type of the air conditioners. The air conditioner data model stores information on the air conditioners for each of data items.

17 Claims, 6 Drawing Sheets

(51) Int. Cl.
*F24F 11/58* (2018.01)
*F24F 110/10* (2018.01)

(56) References Cited

U.S. PATENT DOCUMENTS

| | | | | |
|---|---|---|---|---|
| 2012/0179299 | A1* | 7/2012 | Gyota | F24F 11/30 700/276 |
| 2013/0304259 | A1 | 11/2013 | Meruva et al. | |
| 2014/0277773 | A1 | 9/2014 | Goldschmidt et al. | |
| 2015/0051740 | A1* | 2/2015 | Hiraoka | F24F 11/30 700/276 |
| 2016/0209074 | A1* | 7/2016 | Ito | F04D 27/001 |
| 2018/0202681 | A1* | 7/2018 | Kim | F24F 11/30 |
| 2019/0063779 | A1* | 2/2019 | Komiya | F24F 11/58 |
| 2019/0212027 | A1* | 7/2019 | Muramatsu | H05K 7/20836 |
| 2019/0353372 | A1* | 11/2019 | Rigg | F24F 11/38 |
| 2020/0018510 | A1* | 1/2020 | Iguchi | F24F 11/88 |
| 2020/0133219 | A1* | 4/2020 | Ishizaka | F24F 11/63 |
| 2022/0217009 | A1* | 7/2022 | Fumimoto | F24F 11/63 |
| 2022/0268473 | A1* | 8/2022 | Sakaguchi | G06F 8/30 |

FOREIGN PATENT DOCUMENTS

| | | | |
|---|---|---|---|
| JP | 8-152180 | A | 6/1996 |
| JP | 2004-234176 | A | 8/2004 |
| JP | 2007-71406 | A | 3/2007 |
| JP | 2009-111901 | A | 5/2009 |
| JP | 2009-204185 | A | 9/2009 |
| JP | 2010-38430 | A | 2/2010 |
| JP | 2018-87799 | A | 6/2018 |
| JP | 2019-174076 | A | 10/2019 |
| WO | 2018/087799 | A1 | 5/2018 |

OTHER PUBLICATIONS

International Search Report of corresponding PCT Application No. PCT/JP2020/043899 dated Dec. 28, 2020.

European Search Report of corresponding EP Application No. 20 89 3183.2 dated Dec. 6, 2022.

* cited by examiner

12a

SINGLE FLOW INDOOR UNIT

| DATA ITEM | Input/ Output | Data Type | Property (ATTRIBUTE VALUE) | | | | | | | | | | | | | |
|---|---|---|---|---|---|---|---|---|---|---|---|---|---|---|---|---|
| | | | CURRENT VALUE | R/W | MINIMUM VALUE | R/W | MAXIMUM VALUE | R/W | INITIAL VALUE | R/W | STRIDE | R/W | ... | OPC | Type Of OPC | Data Converter |
| START AND STOP | Output | Binary | 1 | RW | 0 | R | 1 | R | 0 | R | - | - | ... | ** | - | Pattern1 |
| | Input | | 1 | R | - | - | - | - | - | - | - | - | | ** | - | PatternA |
| SET TEMPERATURE | Output | Analog | 27 | RW | ** | R | ** | R | ** | R | 0.1 | R | | ** | - | Pattern2 |
| | Input | | 1 | R | - | - | - | - | - | - | - | - | | ** | - | PatternB |
| SUCTION TEMPERATURE | Input | Analog | 26 | R | - | - | - | - | - | - | 0.1 | R | | ** | - | PatternC |

FIG. 4

12b

SENSING FLOW INDOOR UNIT

| DATA ITEM | Input/ Output | Data Type | Property (ATTRIBUTE VALUE) | | | | | | | | | | | | | |
|---|---|---|---|---|---|---|---|---|---|---|---|---|---|---|---|---|
| | | | CURRENT VALUE | R/W | MINIMUM VALUE | R/W | MAXIMUM VALUE | R/W | INITIAL VALUE | R/W | STRIDE | R/W | *** | OPC | Type Of OPC | Data Converter |
| START AND STOP | Output | Binary | 1 | RW | 0 | R | 1 | R | 0 | R | - | - | *** | ** | - | Pattern1 |
| | Input | | 1 | R | - | - | - | - | - | - | - | - | | ** | - | PatternA |
| SET TEMPERATURE | Output | Analog | 27 | RW | ** | R | ** | R | ** | R | 0.1 | R | | ** | - | Pattern2 |
| | Input | | 1 | R | - | - | - | - | - | - | - | - | | ** | - | PatternB |
| SUCTION TEMPERATURE | Input | Analog | 26 | R | - | - | - | - | - | - | 0.1 | R | | ** | - | PatternC |
| HUMAN DETECTION STATE | Input | Binary | 0 | R | - | - | - | - | - | - | - | - | | ** | - | PatternD |

FIG. 5

12c

FLOORSTANDING INDOOR UNIT

| DATA ITEM | Input/ Output | Data Type | Property (ATTRIBUTE VALUE) | | | | | | | | | | | | | |
|---|---|---|---|---|---|---|---|---|---|---|---|---|---|---|---|---|
| | | | CURRENT VALUE | R/W | MINIMUM VALUE | R/W | MAXIMUM VALUE | R/W | INITIAL VALUE | R/W | STRIDE | R/W | *** | OPC | Type Of OPC | Data Converter |
| START AND STOP | Output | Binary | 1 | RW | 0 | R | 1 | R | 0 | R | - | - | *** | ** | - | Pattern1 |
| | Input | | 1 | R | - | - | - | - | - | - | - | - | | ** | - | PatternA |
| SET TEMPERATURE | Output | Analog | 27 | RW | ** | R | ** | R | ** | R | 0.1 | R | | ** | - | Pattern2 |
| | Input | | 1 | R | - | - | - | - | - | - | - | - | | ** | - | PatternB |
| SUCTION TEMPERATURE | Input | Analog | 26 | R | - | - | - | - | - | - | 0.1 | R | | ** | - | PatternC |
| FLOOR TEMPERATURE | Input | Analog | 17 | R | ** | R | ** | R | ** | R | - | - | | ** | - | PatternE |

FIG. 6

AIR CONDITIONING MANAGEMENT SYSTEM

CROSS-REFERENCE TO RELATED APPLICATIONS

This is a continuation of International Application No. PCT/JP2020/043899 filed on Nov. 25, 2020, which claims priority to Japanese Patent Application No. 2019-213229, filed on Nov. 26, 2019. The entire disclosures of these applications are incorporated by reference herein.

BACKGROUND

Technical Field

The present disclosure relates to an air conditioning management system that manages a plurality of air conditioners as management targets.

Background Art

There has been provided an air conditioning management system for comprehensively managing (monitoring, controlling, and the like) air conditioners such as an outdoor unit and an indoor unit. In such an air conditioning management system, a data center connected to a network such as the Internet or a public network provides a controller with a management program, and the controller executes the management program (JP 2004-234176 A). The management program in JP 2004-234176 A is selected in accordance with device information as information unique to an air conditioner and is provided from the data center.

SUMMARY

An air conditioning management system according to a first aspect is configured to manage a plurality of air conditioners as management targets. The air conditioning management system includes a controller connected to the air conditioners, and a server apparatus connected to the controller. The controller is configured to execute a management program to manage the air conditioners. The server apparatus is configured to provide the controller with an air conditioner data model as a collection of data on the air conditioners to be referred to in the management program. The air conditioner data model is information on the air conditioners to be referred to in the management program. The air conditioner data model is provided for each type of the air conditioners. The air conditioner data model stores information on the air conditioners for each of data items.

BRIEF DESCRIPTION OF THE DRAWINGS

FIG. 4 indicates an exemplary air conditioner data model.

FIG. 5 indicates another exemplary air conditioner data model.

FIG. 6 indicates still another exemplary air conditioner data model.

DETAILED DESCRIPTION OF EMBODIMENT(S)

First Embodiment (1) Entire Configuration

Figure 1:
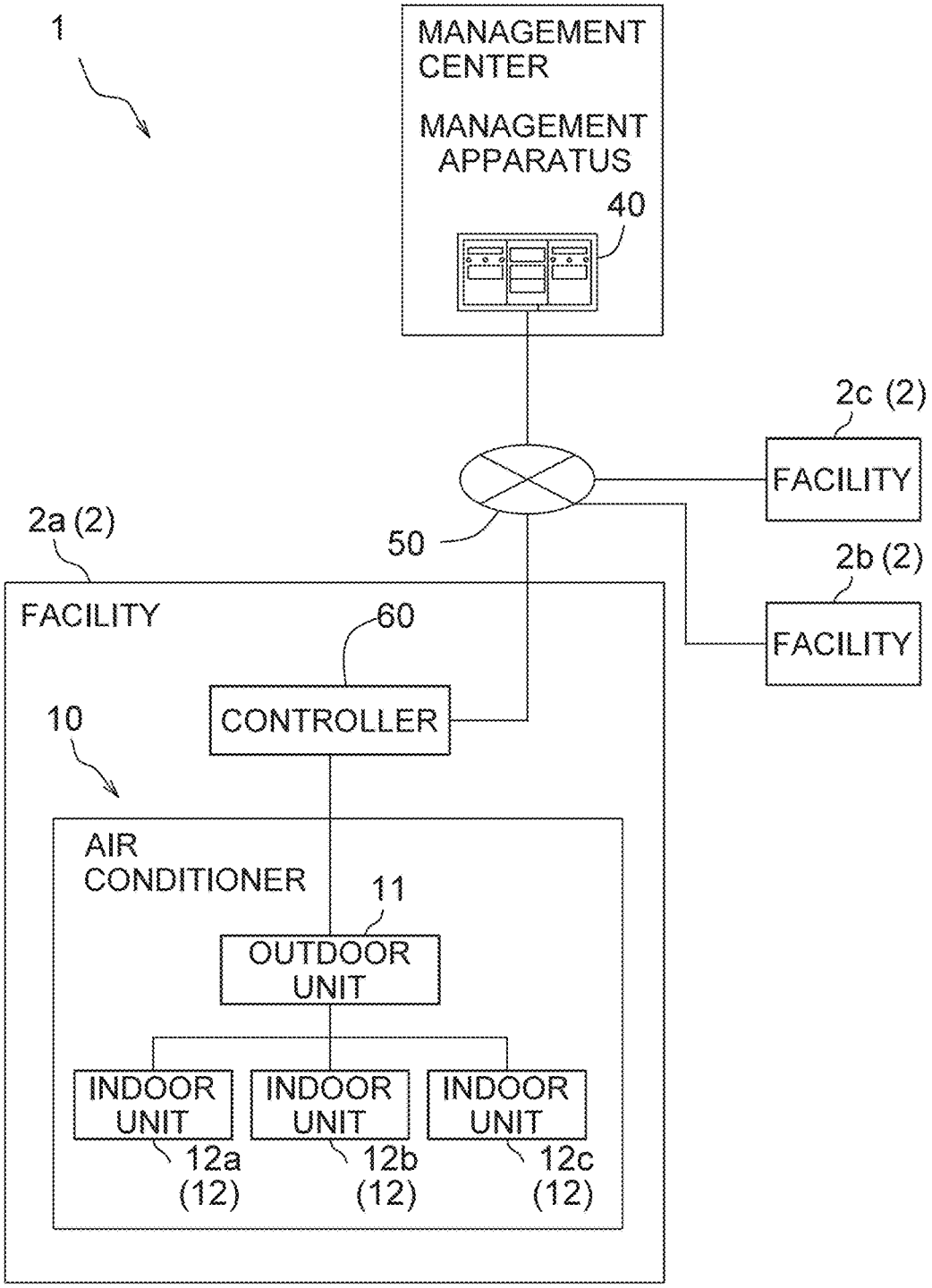
FIG. 1 is a schematic view depicting configuration of an air conditioning management system.

FIG. 1 is a schematic view depicting a configuration of an air conditioning management system 1. When a plurality of devices having similar functions are commonly described below, identical reference signs will be denoted. An English lower-case subscript will be added to distinguished description of one of the devices having similar functions. For example, indoor units 12*a*, 12*b*, and 12*c* have similar functions, and will be each called an indoor unit 12 without using a subscript a, b, and c for common description.

The air conditioning management system 1 includes an air conditioner 10 as a management target, a controller 60 that executes a management program 3 for management of the air conditioner 10, and a server apparatus 40 that provides an air conditioner data model 4 to be referred to in the management program 3 and manages the air conditioner 10.

The server apparatus 40 herein is installed in a central management center. The server apparatus 40 is connected to a communication network 50 such as the Internet. The server apparatus 40 is connected with a plurality of facilities 2 (2*a* to 2*c*). Examples of the facilities 2 include an office building, a commercial building, and a condominium. Each of the facilities 2 is provided with, as management targets, one or a plurality of air conditioners 10 that execute cooling operation or heating operation in the facility 2. The air conditioner 10 includes an outdoor unit 11, and one or a plurality of indoor units 12 (12*a*, 12*b*, and 12*c*). The air conditioner 10 is connected with the controller 60. The controller 60 is connected to the server apparatus 40 via the communication network 50 such as the Internet.

In the air conditioning management system 1, the controller 60 executes the management program 3 to manage the air conditioner 10. Management herein indicates monitoring, operating, or the like of the air conditioner 10. The controller 60 executes the management program 3 in accordance with the air conditioner data model 4 to acquire predetermined data from the air conditioner 10. The air conditioner data model 4 is a collection of data on the air conditioner 10 (the outdoor unit 11 or the indoor unit 12). The air conditioner data model 4 is prepared for each type by a manager or the like of the air conditioning management system 1, and is registered at the server apparatus 40. When the air conditioner data model 4 is registered at the server apparatus 40, the server apparatus 40 provides the controller 60 with the air conditioner data model 4. The air conditioning management system 1 can thus manage a new type of the air conditioner 10.

(2) Air Conditioner as Management Target

Figure 2:
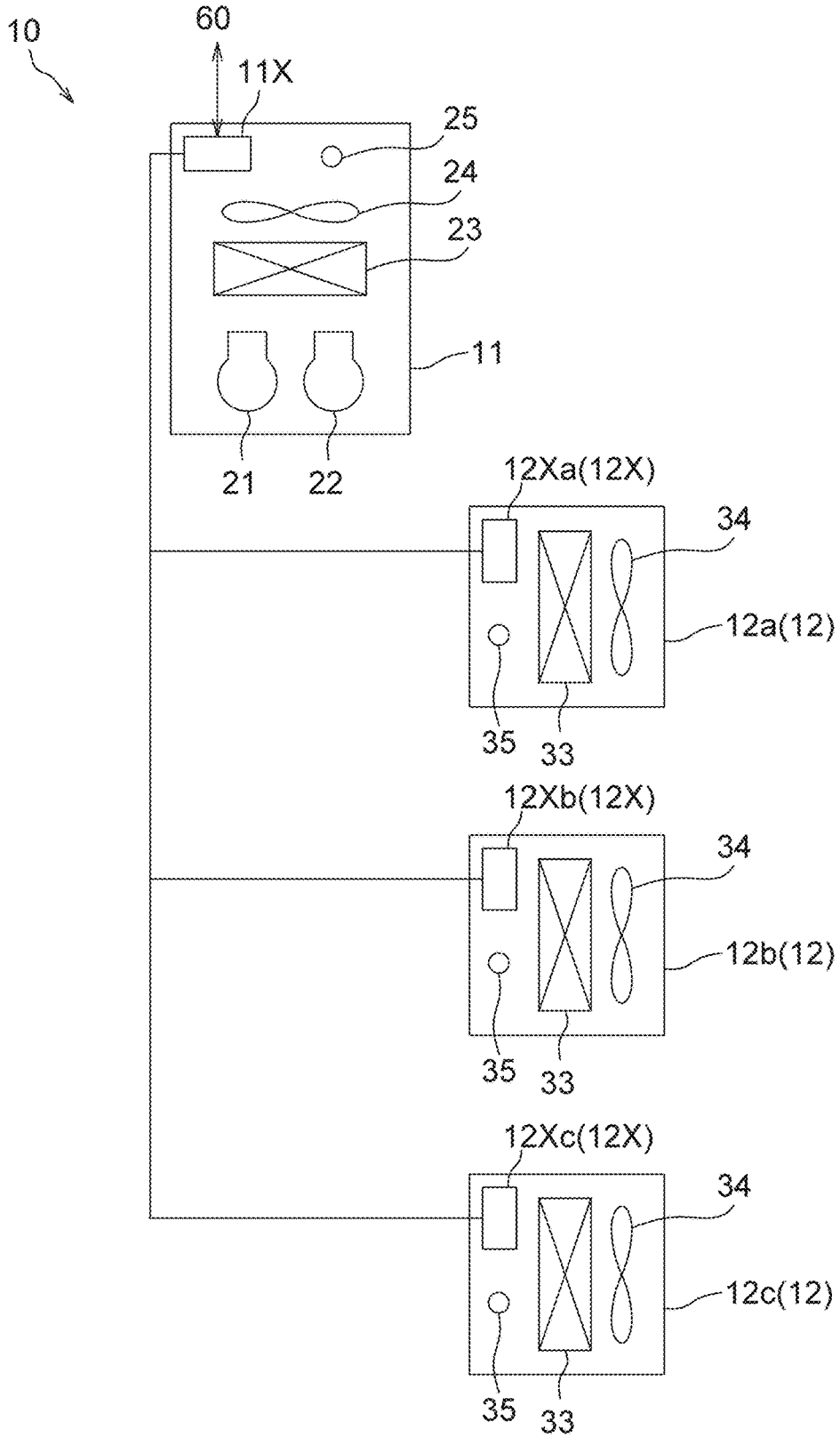
FIG. 2 is a schematic view depicting a configuration of an air conditioner.

FIG. 2 is a schematic view depicting a configuration of the air conditioner 10. As described above, the air conditioner 10 as the management target of the air conditioning management system 1 includes the outdoor unit 11, and the one or the plurality of indoor units 12. The outdoor unit 11 is disposed on a roof, in a basement, or the like. The indoor units 12 are dispersedly installed on a plurality of floors, in a plurality of rooms, or the like of the facilities 2.

The outdoor unit 11 includes a compressor 21, an outdoor heat exchanger 23, an outdoor fan 24, a sensor 25, an outdoor unit controlling unit 11X, and the like. Each of the indoor units 12*a*, 12*b*, and 12*c* includes an indoor heat exchanger 33, an indoor fan 34, a sensor 35, an indoor unit controlling unit 12X (12Xa, 12Xb, and 12Xc), and the like.

The outdoor unit 11 (the outdoor unit controlling unit 11X) and the indoor unit 12 (the indoor unit controlling unit 12X) are connected to each other via a dedicated communication line. The outdoor unit controlling unit 11X and the indoor unit controlling unit 12X cooperatively control operation of each unit in the air conditioner 10 in accordance with detection values of the sensors 25 and 35 or the like. The server apparatus 40 collects, via the communication network 50, data on the outdoor unit 11 and the indoor unit 12 from the outdoor unit controlling unit 11X and the indoor unit controlling unit 12X. The outdoor unit controlling unit 11X transmits and receives the data on the outdoor unit 11 and the indoor unit 12 to and from the controller 60. The air conditioner 10 is managed in accordance with a command inputted to the controlling units 11X and 12X from a remote controller or the like attached to each of the indoor units 12 or via the communication network 50, the server apparatus 40, and the controller 60.

(3) Detailed Configuration of Air Conditioning Management System

Figure 3:
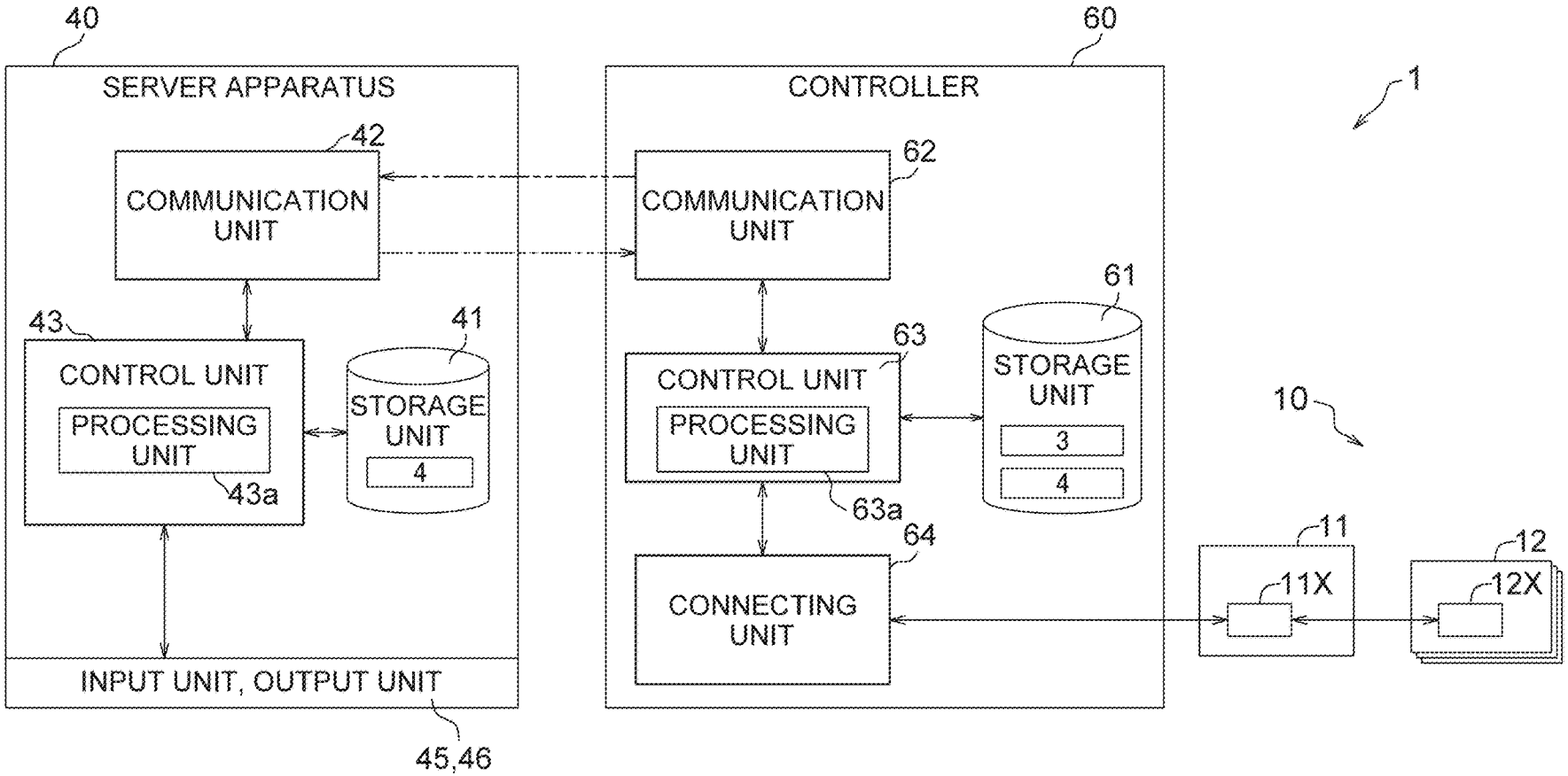
FIG. 3 is a schematic view depicting functional blocks of devices constituting the air conditioning management system.

FIG. 3 is a schematic view depicting functional blocks of devices constituting the air conditioning management system 1.

(3-1) Controller

The controller 60 is connected to the outdoor unit controlling unit 11X of the outdoor unit 11 to manage the air conditioner 10. The controller 60 is a computer for managing the air conditioner 10, and is exemplarily called a gateway or an edge. The controller 60 may be constituted by a plurality of computers and devices connected via a network. The controller 60 includes a storage unit 61, a communication unit 62, a processing unit 63*a*, and a connecting unit 64.

The storage unit 61 is configured to store various information, and may include a ROM, a RAM, and/or a hard disk, etc. The storage unit 61 stores various programs for execution of various functions of the controller 60, and various data for execution of the programs. Specifically, the storage unit 61 stores the management program 3 for management of the air conditioner 10, the air conditioner data model 4 (to be described later) to be referred to in the management program 3, and a conversion function for data conversion. The management program 3 may be provided from the server apparatus 40 via the communication unit 62 to be described later, or may be preliminarily included in the controller 60. The conversion function is used for interconversion between data recognizable by the air conditioner 10 and data recognizable by the server apparatus 40. The air conditioner data model 4 is linked with information on the conversion function for conversion of each piece of data, and the controller 60 uses the conversion function to process data interconversion.

The communication unit 62 is an interface or the like for communication with the communication network 50 via a public network, a router, or the like (not depicted). The communication unit 62 is functioned to achieve communication between the controller 60 and the server apparatus 40, of data on the air conditioner 10 including various commands. The controller 60 receives the air conditioner data model 4 from the server apparatus 40 via the communication unit 62.

A control unit 63 is constituted by a CPU, a cache memory, and the like. The control unit 63 cooperates with remaining constituents of the controller 60 to control the entire controller 60. The control unit 63 includes the processing unit 63*a* that processes various information in the controller 60. For example, the processing unit 63*a* acquires data from the outdoor unit 11 and the indoor unit 12 via the connecting unit 64 to store the data in the storage unit 61. The processing unit 63*a* processes, with use of the conversion function, interconversion between data recognizable by the air conditioner 10 and data recognizable by the server apparatus 40. The processing unit 63*a* causes the communication unit 62 to transmit various commands received from the server apparatus 40 to the outdoor unit 11 and the indoor unit 12 at predetermined timing.

The connecting unit 64 is an interface to be connected to the outdoor unit controlling unit 11X. The controller 60 can thus transmit various commands to the outdoor unit controlling unit 11X and receive data from the outdoor unit controlling unit 11X via the connecting unit 64.

(3-2) Server Apparatus

The server apparatus 40 is connected to the controller 60 via the communication network 50 to manage the air conditioner 10. The server apparatus 40 is a computer that manages the air conditioner 10, such as a supercomputer, a workstation, a personal computer, or cloud computing. The server apparatus 40 includes a storage, unit 41, a communication unit 42, a processing unit 43*a*, an input unit 45, and an output unit 46.

The storage unit 41 is configured to store various information, and includes a ROM, a RAM, and/or a hard disk, etc. For example, the storage unit 41 stores various programs for execution of various functions of the server apparatus 40, and various data for execution of the programs. Specifically, the storage unit 41 stores the management program 3, and the air conditioner data model 4 to be referred to in the management program 3. The air conditioner data model 4 is stored (registered) at the storage unit 41 via the input unit 45 to be described later or the communication unit 42 to be described later. When the air conditioner data model 4 is registered at the storage unit 41 of the server apparatus 40, the processing unit 43*a* provides the air conditioner data model 4 to the controller 60 via the communication unit 42.

The communication unit 42 is an interface or the like for communication with the controller 60 and the like via a public network, a router, or the like (not depicted). Specifically, the communication unit 42 executes communication with the controller 60, of data on the air conditioner 10 including various commands.

A control unit 43 is constituted by a CPU, a cache memory, and the like. The control unit 43 cooperates with remaining constituents of the server apparatus 40 to control the entire server apparatus 40. The control unit 43 includes the processing unit 43*a* that processes various information in the server apparatus 40. For example, the processing unit 43*a* stores, in the storage unit 41, data on the air conditioner (the outdoor unit 11 and the indoor unit 12) as a management target, the data acquired from the controller 60. The processing unit 43*a* further manages the air conditioner in accordance with the data stored in the storage unit 41.

The input unit 45 is an interface for input of information to the server apparatus 40. The input unit 45 is implemented by a keyboard, a mouse, and/or a touch screen, etc.

The output unit 46 is configured to output various information and is constituted by any type of a display, a speaker, and the like.

(4) Air Conditioner Data Model

The air conditioner data model 4 is a collection of data on each type of the air conditioners 10. Each type of the air conditioners 10 indicates each model of the outdoor unit 11 or the indoor unit 12, and a different model is set for different horse power, capacity, or the like of the outdoor unit 11 or the indoor unit 12.

For example, FIG. 4 is a schematic chart indicating the air conditioner data model 4 for the indoor unit 12*a*. The indoor unit 12*a* is a single flow indoor unit (type A), and the air conditioner data model 4 for the indoor unit 12*a* includes data on start and stop, set temperature, and suction temperature. FIG. 5 is a schematic chart indicating the air conditioner data model 4 for the indoor unit 12*b*. The indoor unit 12*b* is a four-way blowable cassette indoor unit (type B), and the air conditioner data model 4 for the indoor unit 12*h* includes data on start and stop, set temperature, suction temperature, and a human detection state. FIG. 6 is a schematic chart indicating the air conditioner data model 4 for the indoor unit 12*c*. The indoor unit 12*c* is a floorstanding indoor unit (type C), and the air conditioner data model 4 for the indoor unit 12*c* includes data on start and stop, set temperature, suction temperature, and floor temperature. The air conditioner data model 4 for the indoor unit 12 can obviously include any other data. Each piece of data is linked with items such as "Input/Output", "Data Type", and "Property (Attribute)" to indicate data on the indoor unit 12*a*, 12*b*, and 12*c* in more detail.

Specifically, the item "Input/Output" indicates that the data is an input value or an output value. The item "Data Type" indicates whether acquired data is analog data or binary data.

The item "Property (Attribute)" includes a current value indicating a current state of the air conditioner 10, an environmental state around the air conditioner 10, and a set value. The current value includes data acquired by the controller 60 from the air conditioner 10 via the connecting unit 64. A minimum value and a maximum value indicates a minimum value and a maximum value of a manageable value for the type. The minimum value and the maximum value exemplarily indicates a minimum value and a maximum value of the set temperature for the air conditioner 10. An initial value indicates a value initially set for the type. A stride indicates a stride of a manageable set value for the type. OPC indicates a communication command set for the type. Type of OPC indicates information for specification of the air conditioner 10 in accordance with the communication command. Data Converter indicates information on the conversion function used for conversion of the data item.

The information on the conversion function enables selection of one of a plurality of conversion functions stored in the controller 60. Examples of the information on the conversion function include a function ID preliminarily set for each of the conversion functions.

(5) Provision of Air Conditioner Data Model 4

Described hereinafter is a method of providing the air conditioner data model 4.

In the air conditioning management system 1, the controller 60 stores, in the storage unit 61, the management program 3 for management of the air conditioner 10. The manager or the like of the air conditioning management system 1 prepares the air conditioner data model 4 on an air conditioner newly introduced, and stores the air conditioner data model 4 thus prepared in the storage unit 41 of the server apparatus 40. The model is stored in the storage unit 41 of the server apparatus 40 when the manager or the like transmits the air conditioner data model 4 from a computer, a tablet terminal, or the like for the manager to the communication unit 42 of the server apparatus 40 via the communication network 50 such as the Internet. When the new air conditioner data model 4 is stored (registered) at the storage unit 41, the processing unit 43*a* of the server apparatus 40 transmits the air conditioner data model 4 from the communication unit 42 to the communication unit 62 of the controller 60 via the communication network 50 such as the Internet. The processing unit 63*a* of the controller 60 stores the air conditioner data model 4 thus received in the storage unit 61. The controller 60 can thus execute the management program 3 with reference to the air conditioner data model 4. At this time, the controller 60 may acquire the conversion function as information for execution of the program.

(6) Execution of Management Program 3

The controller 60 acquires data from the air conditioner 10 via the connecting unit 64. The data thus acquired is stored in a predetermined region of the air conditioner data model 4 indicated in FIG. 4 to FIG. 6.

The server apparatus 40 communicates with the controller 60 upon receipt of a request acquired via the input unit 45 or the communication unit 42 or at intervals of predetermined time, and manages the air conditioner 10 in accordance with the air conditioner data model 4 stored in the controller 60. Managing the air conditioner 10 includes monitoring the air conditioner 10 or transmitting a command or the like to the air conditioner 10 or a different device. At this time, the processing unit 63*a* of the controller 60 refers to the information on the conversion function included in the air conditioner data model 4 to convert data in accordance with the conversion function. Specifically, the processing unit 63*a* convers data stored in the predetermined region of the air conditioner data model 4 to data recognizable by the server apparatus 40 in accordance with the conversion function included in the air conditioner data model 4.

(7) Features (7-1)

The air conditioning management system 1 according to the present disclosure manages the plurality of air conditioners 10 (the outdoor unit 11 and the indoor units 12) as management targets. The air conditioning management system 1 includes the controller 60 and the server apparatus 40. The controller 60 is connected to the air conditioners 10. The controller 60 executes the management program 3 for management of the air conditioners 10. The controller 60 is connected to the server apparatus via the network. The server apparatus 40 is connected to the controller 60. The server apparatus 40 provides the controller 60 with the air conditioner data model 4 as a collection of data on the air conditioners to be referred to in the management program 3. The air conditioner data model 4 is provided for each type of the air conditioners 10. The air conditioner data model 4 includes the information on the conversion function for interconversion between data acquired from the air conditioners and data recognizable by the server apparatus.

When the air conditioner data model 4 is registered at the server apparatus 40 in the air conditioning management system 1, the server apparatus 40 provides the controller 60 with the air conditioner data model 4.

A different program for management of an air conditioner may be applied to each air conditioner as a management target. In an exemplary case where a new air conditioner is introduced, the existing management program included in the controller may fail to achieve sufficient management. Conventional technology needs development of a corresponding management program for management of a newly introduced air conditioner. Development of a management program problematically requires enormous work time and processes.

In a conventional air conditioning management system, the management program 3 has been prepared in accordance with information (the air conditioner data model 4) unique to the air conditioners. The existing management program 3 thus prepared may occasionally fail to achieve sufficient management when a new air conditioner is introduced to the air conditioning management system. In an exemplary case where a new type of the air conditioners is introduced to the air conditioning management system, it has been necessary to develop a management program for the new type of the air conditioners. Development of a management program problematically requires enormous work time and processes.

In view of this, the air conditioning management system 1 according to the present disclosure is configured as described above to start management of a new air conditioner 10 added to the air conditioning management system 1, without development of any new management program 3. Accordingly, the air conditioning management system 1 can continuously manage the air conditioners 10.

In the air conditioning management system 1, the server apparatus 40 provides the air conditioner data model 4 to enable management with use of an identical management program 3 even when a new air conditioner 10 is introduced.

The air conditioning management system 1 can manage a new type of the air conditioners 10 introduced to the air conditioning management system 1 with use of the identical management program 3.

The air conditioner data model 4 includes the information on the conversion function, which can achieve interconversion between data acquired from the air conditioners and data recognizable by the server apparatus.

The controller 60 and the server apparatus 40 can achieve data conversion in a recognizable language.

(8) Modifications

In the air conditioning management system 1 according to the present disclosure, the controller 60 may provide the air conditioner data model 4 in the following manner.

Initially, the manager or the like of the air conditioning management system 1 prepares the air conditioner data model 4 for an air conditioner newly introduced, and stores the air conditioner data model 4 thus prepared in the storage unit 41 of the server apparatus 40. The model is stored in the storage unit 41 of the server apparatus 40 when the manager or the like transmits the air conditioner data model 4 from a computer, a tablet terminal, or the like for the manager to the communication unit 42 of the server apparatus 40 via the communication network 50 such as the Internet.

Subsequently, the air conditioner is installed in one of the facilities 2, and the outdoor unit controlling unit of the air conditioner and the connecting unit 64 of the controller 60 are connected to each other. The controller 60 acquires type information on the outdoor unit and the indoor unit of the air conditioner via the connecting unit 64. The controller 60 transmits the type information acquired from the air conditioner to the server apparatus 40 via the communication network 50, to request transmission of the air conditioner data model corresponding to the type information. When the server apparatus 40 transmits the air conditioner data model to the controller 60 in response to this request, the controller 60 is provided with the air conditioner data model for the new air conditioner.

(9)

The embodiment of the present disclosure has been described above. Various modifications to modes and details should be available without departing from the object and the scope of the present disclosure recited in the claims.

The invention claimed is:

1. An air conditioning management system configured to manage a plurality of air conditioners as management targets, the air conditioning management system comprising:

a controller connected to at least one air conditioner among the plurality of air conditioners, the controller including a storage storing a management program and a processor configured to execute the management program to manage the at least one air conditioner; and a server apparatus connected to the controller, the server apparatus being configured to provide the controller with an air conditioner data model as a collection of data on the at least one air conditioner, the management program being configured to refer to the air conditioner data model to manage the at least one air conditioner, the air conditioner data model being one of a plurality of air conditioner data models stored in the server apparatus, each of the plurality of air conditioner data models being unique to each type of air conditioner among the plurality of air conditioners and including a plurality of data items that are set for each type of air conditioner among the plurality of air conditioners, the air conditioner data model including information on the at least one air conditioner for each of the plurality of data items, the controller being configured to acquire type data on the at least one air conditioner and transmit the type data to the server apparatus, and the server apparatus being configured to provide the controller with the air conditioner data model, the air conditioner data model being an air conditioner data model among the plurality of air conditioner data models that corresponds to the type data.

2. The air conditioning management system according to claim 1, wherein the information on the at least one air conditioner includes information on attributes of the at least one air conditioner.

3. The air conditioning management system according to claim 2, wherein the information on the attributes includes information on a possible maximum value and a possible minimum value of numerical value data.

4. The air conditioning management system according to claim 3, wherein the data items include an item of start and stop, set temperature, or suction temperature.

5. The air conditioning management system according to claim 3, wherein the controller is connected to the server apparatus via a network.

6. The air conditioning management system according to claim 3, wherein when the air conditioner data model is registered at the server apparatus, the server apparatus provides the controller with the air conditioner data model.

7. The air conditioning management system according to claim 2, wherein the data items include an item of start and stop, set temperature, or suction temperature.

8. The air conditioning management system according to claim 2, wherein the controller is connected to the server apparatus via a network.

9. The air conditioning management system according to claim 2, wherein when the air conditioner data model is registered at the server apparatus, the server apparatus provides the controller with the air conditioner data model.

10. The air conditioning management system according to claim 2, wherein the air conditioner data model includes information on a conversion function for interconversion between data acquired from the at least one air conditioner and data recognizable by the server apparatus.

11. The air conditioning management system according to claim 1, wherein the controller is configured to acquire the type data from the at least one air conditioner when the controller and the at least one air conditioner are connected to each other.

12. The air conditioning management system according to claim 1, wherein the data items include an item of start and stop, set temperature, or suction temperature.

13. The air conditioning management system according to claim 1, wherein the controller is connected to the server apparatus via a network.

14. The air conditioning management system according to claim 1, wherein when the air conditioner data model is registered at the server apparatus, the server apparatus provides the controller with the air conditioner data model.

15. The air conditioning management system according to claim 1, wherein the air conditioner data model includes information on a conversion function for interconversion between data acquired from the at least one air conditioner and data recognizable by the server apparatus.

16. The air conditioning management system according to claim 1, wherein when a new air conditioner is connected to the controller, the controller acquires new type data on the new air conditioner and transmits the new type data to the server apparatus, the server apparatus provides the controller with a new air conditioner data model for the new air conditioner in accordance with the new type data, and the controller controls the new air conditioner by executing the management program with reference to the new air conditioner data model, the management program executed to control the new air conditioner being identical to the management program executed to control the at least one air conditioner.

17. The air conditioning management system according to claim 1, wherein the management program is an executable program configured to control any one of the plurality of air conditioners by referring to one air conditioner data model among the plurality of air conditioner data models, the one air conditioner data model corresponds to the one of the plurality of air conditioners.

* * * * *